US009478917B2

(12) United States Patent
Strobl et al.

(10) Patent No.: US 9,478,917 B2
(45) Date of Patent: Oct. 25, 2016

(54) MECHATRONIC PLUG-IN CONNECTOR SYSTEM

(71) Applicant: ELLENBERGER & POENSGEN GMBH, Altdorf (DE)

(72) Inventors: Christian Strobl, Burgthann (DE); Michael Naumann, Feucht (DE); Frank Gerdinand, Helmstedt (DE)

(73) Assignee: Ellenberger & Poensgen GmbH, Altdorf (DE)

( * ) Notice: Subject to any disclaimer, the term of this patent is extended or adjusted under 35 U.S.C. 154(b) by 348 days.

(21) Appl. No.: 14/176,520

(22) Filed: Feb. 10, 2014

(65) Prior Publication Data

US 2014/0154904 A1 Jun. 5, 2014

Related U.S. Application Data

(63) Continuation of application No. PCT/EP2012/002913, filed on Jul. 10, 2012.

(30) Foreign Application Priority Data

Aug. 10, 2011 (DE) ..... 10 2011 109 920

(51) Int. Cl.
*H01R 13/66* (2006.01)
*H01R 13/703* (2006.01)

(52) U.S. Cl.
CPC ..... *H01R 13/665* (2013.01); *H01R 13/7038* (2013.01)

(58) Field of Classification Search
CPC ..... H01R 13/665; H01R 13/7038
USPC ..... 361/2
See application file for complete search history.

(56) References Cited

U.S. PATENT DOCUMENTS 4,346,419 A 8/1982 Janniello
4,843,514 A 6/1989 Bodkin (Continued)

FOREIGN PATENT DOCUMENTS

CN 101640350 A 2/2010
DE 198 38 492 A1 3/2000

(Continued)

OTHER PUBLICATIONS

Machine Translation German Patent Document of DE 202009004198 U1, Naumann et al. Sep. 16, 2010.*
Japanese Office Action for Japanese Application No. 2014-524285 dated Jul. 14, 2015 with English translation.

*Primary Examiner* — Thienvu Tran
*Assistant Examiner* — Kevin J Comber
(74) *Attorney, Agent, or Firm* — Muncy, Geissler, Olds & Lowe, P.C.

(57) ABSTRACT

A mechatronic plug-in connector system having a main contact and an auxiliary contact which lags during an unplugging operation and with a semiconductor electronic which is series-connected to the auxiliary contact and is parallel-connected to the main contact for extinguishing an arc produced during the unplugging operation, wherein the semiconductor electronic has two series-connected semiconductor switches and an energy accumulator which is connected to the semiconductor switches and which for charging taps the arc voltage produced between the semiconductor switches during the unplugging operation. The invention further relates to a multiple plug system having at least two plug-in connectors each having a main contact and a lagging auxiliary contact and with a semiconductor electronic which is common to the plug-in connectors and is series-connected to each of the auxiliary contacts via a diode.

6 Claims, 4 Drawing Sheets

(56) References Cited

U.S. PATENT DOCUMENTS

| | | | | |
|---|---|---|---|---|
| 5,726,506 | A * | 3/1998 | Wood | H02B 1/24 307/147 |
| 8,742,828 | B2 | 6/2014 | Naumann et al. | |
| 2003/0054683 | A1 * | 3/2003 | Bryan | H01R 13/66 439/181 |

FOREIGN PATENT DOCUMENTS

| | | | |
|---|---|---|---|
| DE | 102 25 259 | B3 | 1/2004 |
| DE | 20 2009 004 198 | U1 | 8/2010 |
| EP | 2 144 339 | A1 | 1/2010 |
| WO | WO 2010/106565 | A1 | 9/2010 |

* cited by examiner

MECHATRONIC PLUG-IN CONNECTOR SYSTEM

This nonprovisional application is a continuation of International Application No. PCT/EP2012/002913, which was filed on Jul. 10, 2012, and which claims priority to German Patent Application No. DE 10 2011 109 920.8, which was filed in Germany on Aug. 10, 2011, and which are both herein incorporated by reference.

BACKGROUND OF THE INVENTION

1. Field of the Invention

The present invention relates to a mechatronic plug-in connector system with a main contact and with an auxiliary contact, which lags behind the main contact during an unplugging operation, and with a semiconductor electronic device, which is series-connected to the auxiliary contact and parallel-connected to the main contact, for extinguishing an arc produced during an unplugging operation. It relates further to a mechatronic multi-plug system in the manner of a multiple socket or outlet strip.

2. Description of the Background Art

DE 102 25 259 B3 discloses an electrical plug-in connector with a main contact and with an auxiliary contact lagging behind it during an unplugging operation and with a semiconductor switching element in the form of a transistor or thyristor, which is series-connected to the auxiliary contact and parallel-connected to the main contact. The semiconductor switching element is permanently controlled by means of a rectangular generator both in the case of the plugged-in and a disengaged (pulled out) main contact and thereby turned on and off periodically. The semiconductor switching element is opened, before the auxiliary contact is separated, whereby the current flowing across the semiconductor switching element is turned off or at least reduced chronologically before a contact separation at the auxiliary contact, so that no stable arc can be produced.

In fact, in the case of a plugged-in main contact because of the current flow conducted across it, the semiconductor switch parallel hereto is currentless. However, because the rectangular generator is permanently operated, the semiconductor switch is also permanently actuated, namely, turned on and off periodically.

SUMMARY OF THE INVENTION

It is therefore an object of the present invention to provide an especially suitable mechatronic plug-in connection system. Further, a multi-plug system with a number of mechatronic plug-in connections is provided.

The mechatronic plug-in connection system, in an embodiment, can include a main contact, which has a main plug-in contact and a main opposite contact, particularly a plug socket. The plug-in connection system includes further an auxiliary contact, which has an auxiliary plug-in contact and an auxiliary opposite contact, again particularly in the form of a socket. A semiconductor electronic device for extinguishing an arc produced during an unplugging operation is series-connected to the auxiliary contact, whereby said series connection is parallel-connected to the main contact. During the unplugging operation the auxiliary contact lags behind the main contact, in that in the main contact the distance between the contact tip of the main plug-in contact and the contact end of the main opposite contact, i.e., its socket opening edge, said distance which is designated below as the contact difference, is smaller in a plug socket in the plugged-in state than in the auxiliary plug-in contact.

The semiconductor electronic device used as taught by the invention has two series-connected semiconductor switches, preferably an IGBT and a MOSFET. An energy storage device, which for its charging taps the arc produced between the semiconductor switches during the unplugging operation, is placed between the two semiconductor switches.

The main contact of the plug-in connection system, also called a plug-in connector below, can be connected into a forward and return conductor between a DC voltage source and a load or a load terminal. In this regard, the main plug-in contact is connected to the load or the load terminal, whereas the main opposite contact is connected to the DC voltage source. By analogy, the auxiliary plug-in contact of the auxiliary contact, parallel-connected to the main contact, is connected to the load or the load terminal and the auxiliary opposite contact via the semiconductor electronic device and hereby to the DC voltage source (DC source) via the series connection of the two semiconductor switches.

In an embodiment, a third contact with a plug-in contact, again connected to the load or load terminal, and with an opposite contact, suitably also realized in the form of a plug socket, is connected directly to the DC voltage source. In this regard, the third contact is connected to the return conductor when the main contact is in the forward conductor. Otherwise, the third contact is connected to the forward conductor, when the main contact is located in the return conductor between the DC voltage source and the load or the load terminal.

In an embodiment, the third contact lags behind the main contact in an unplugging operation, i.e., during opening or pulling out of the plug-in connection. To this end, analogously to the distance (contact difference) between the contact tip of the plug-in contact and the contact end of the opposite contact, i.e., its socket opening edge in the case of a plug socket, is greater in the plugged-in state than in the main contact and, for example, is the same as that of the auxiliary plug-in contact.

The multi-plug system, in an embodiment, can have at least two plug-in connectors (plug-in connector systems) each with a main contact and an auxiliary contact, which lags behind the main contact during the unplugging operation. The or each plug-in connector again can have a third contact. Its plug-in contact is suitably designed in such a way that the third contact lags behind the auxiliary contact during the unplugging operation.

The particular plug-in connector of the multi-plug system has a diode in the current path parallel to the main contact with the series connection of the semiconductor electronic device and the auxiliary contact, particularly its auxiliary opposite contact. Said diode is connected on the anode side to the semiconductor electronic device and on the cathode side to the auxiliary contact, when the auxiliary contact and the semiconductor electronic device are connected on the positive side or parallel to the positive or forward line between the DC source and a load (load terminal).

In the unplugging operation, the diodes of the other plug-in connector prevent a short circuit of the semiconductor electronic device by the plugged-in plug-in contacts of the other plug-in connector in the multi-plug system, in that a current flow, parallel to the semiconductor electronic device across present conductor connections and across the plugged-in main and auxiliary contact(s) of the multi-plug system, is eliminated.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

The plug-in connectors or plug-in connector systems S, $S_n$, shown in FIGS. 1 to 4, are intended for use in, for example, DC voltage networks or DC networks with DC voltages of 15 V to about 1500 V and direct currents (DC) of 0.5 A to about 50 A.

During the pulling out or disengaging of the electrical plug-in connector (plug-in connector system), called the unplugging operation below, under load arcs can be produced between the contacts, when the source voltage exceeds about 15 V and the current flowing across the conductor(s) during operation exceeds about 0.5 A. In addition to direct danger to people, the contact system can be damaged by combustion and the insulation material can be damaged due to the high temperatures of the arc plasma, which in turn can lead to consequential damage.

In the conceptualization of such DC plug-in connector systems with integrated arc suppression, it must be considered, moreover, that an arc can be extinguished only at a certain arc length and the finite time to reach this arc length depends on the speed of the pulling motion during the unplugging operation and the source voltage, as well as the load and the contact material.

These conceptual conditions are met not only reliably but also in a simple manner and with practically minimal power losses with the plug-in connector systems (FIGS. 1 to 3) and the multi-plug system (FIG. 4) of the invention. The plug-in connector systems (FIGS. 1 to 3) or the multi-plug system (FIG. 4) are advantageously suitable particularly for installation systems.

Figure 1:
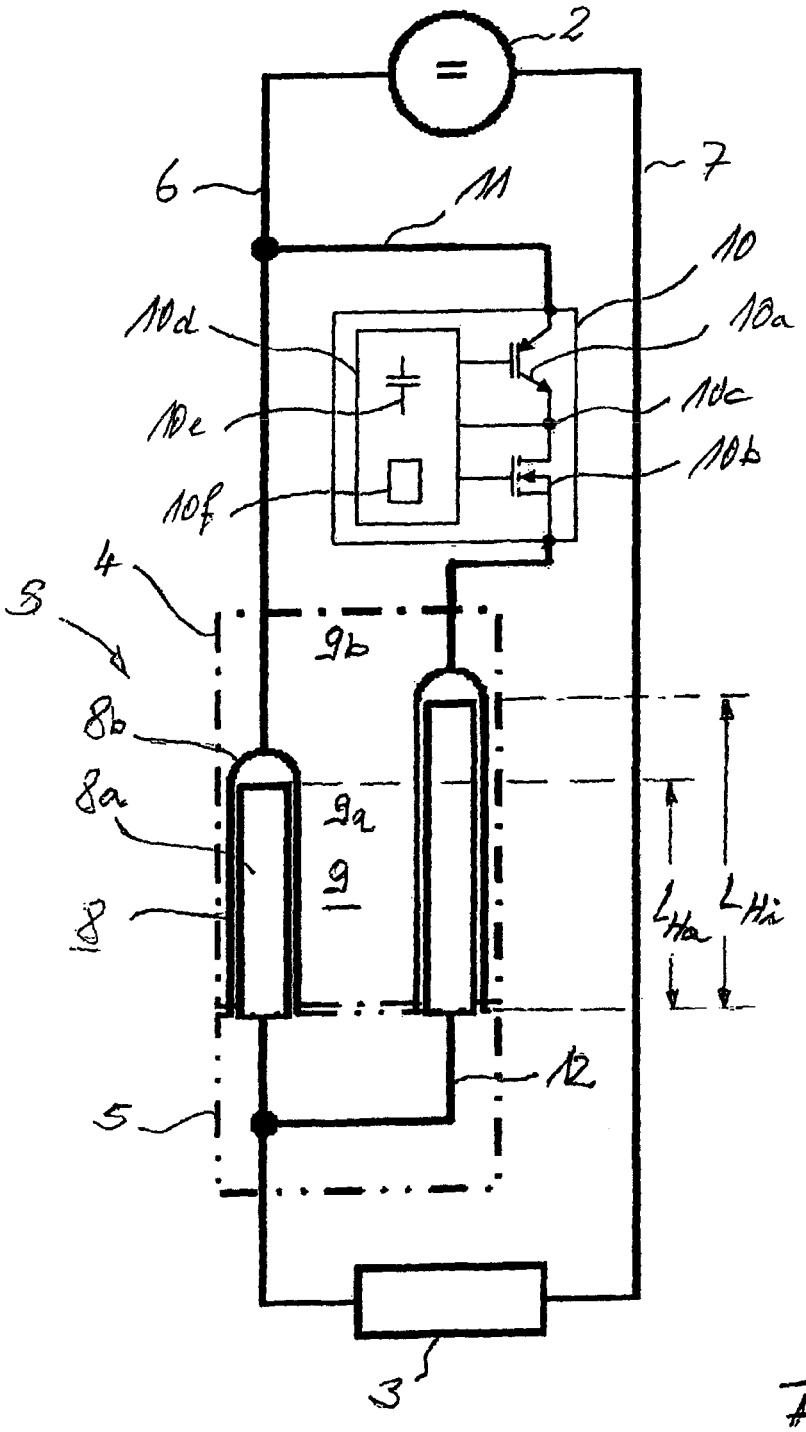
FIG. 1 shows schematically a mechatronic plug-in connection system with a main contact and an auxiliary contact and a semiconductor electronic device with two series-connected semiconductor switches and an energy storage device.

FIG. 1 shows schematically a plug-in connector system 5, designated as a plug-in connector for short, between a direct current source or DC voltage source (DC source) 2 and a load 3 or load group operated by it with a source-side socket unit 4 and a load-side plug unit 5 and with cabling with a forward conductor 6 and a return conductor 7 for connecting load 3 to DC source 2. Plug-in connector 1 comprises a main contact 8 with a main plug-in contact 8*a* and a main opposite contact 8*b* in the form of a plug socket. Socket unit 4 and plug unit 5 are mechanically connected fixedly but detachably to one another.

Main contact 8 in the exemplary embodiment assigned to return conductor 6 is an auxiliary contact 9 with an auxiliary plug-in contact 9*a* and an auxiliary opposite contact 9*b* again designed as a plug socket. Main contact 8 and auxiliary contact 9 are arranged within the socket and plug unit 4 and 5, respectively, in such a way that plug unit 5 together with main plug-in contact 8*a* and auxiliary plug-in contact 9*a* can be pulled out of socket unit 4 with main opposite contact 8*b* and auxiliary opposite contact 9*b* during an unplugging operation.

A semiconductor electronic device 10 is series-connected to auxiliary contact 9 and is connected via an electrical connection or source-side bypass line 11 to forward conductor 6. Analogously, auxiliary plug-in contact 9*a* is connected via an electrically conductive connection or load-side bypass line 12 to main plug-in contact 8*a* and therefore to forward conductor 6. The series connection of semiconductor electronic device 10 and auxiliary contact 9 is therefore parallel-connected to main contact 8.

It is evident that main contact 8 and therefore its main plug-in contact 8*a* [are] longer than auxiliary contact 9 or its auxiliary plug-in contact 9*a*. The contact distance $L_{Ha}$ of main contact 8 (between the contact tip of main plug-in contact 8*a* and the socket opening edge of main opposite contact 8*b*) is therefore shorter than the contact distance $L_{Hi}$ of auxiliary contact 9 (between the contact tip of auxiliary plug-in contact 9*a* and the socket opening edge of auxiliary plug-in contact 9*a*). Therefore, auxiliary contact 9 lags behind main contact 8 during an unplugging operation. In other words, auxiliary plug-in contact 9*a* and auxiliary opposite contact 9*b* are still connected mechanically and therefore electrically conductively, when during the unplugging operation the direct connection between main plug-in contact 8*a* and main opposite contact 8*b* of main contact 8 is already disengaged and optionally bridged by an arc.

In the illustrated state, the bypass (current path) 11, 12 across semiconductor electronic device 10 is currentless, so that it does not consume any power. Semiconductor electronic device 10 suitably comprises a series connection of a first semiconductor switch 10*a* in the form of an IGBT (insulated-gate bipolar transistor) and a second semiconductor switch 10*b* in the form of a MOSFET (metal oxide semiconductor field effect transistor). The two semiconductor switches 10*a* and 10*b* are connected on the base or gate side and via tap 10*c* provided between these to a control circuit 10*d*, which contains an energy storage device 10*e* in the form of preferably a capacitor and a timing member 10*f*. Tap 10*c* between the two semiconductor switches 10*a* and 10*b* is connected to energy storage device 10*e*.

During the pulling out of plug unit 5 and therefore during the unplugging operation, an arc can be produced first between main plug-in contact 8*a* and main opposite contact 8*b*. The resulting voltage difference activates semiconductor electronic device 10, which then takes over the current, which therefore commutates from main contact 8 to auxiliary contact 9. The arc voltage produced during the unplugging operation due to the arc is tapped between the two semiconductor switches 10*a* and 10*b* and used for charging energy storage device 10*e*. The thereby stored charging energy is used for switching through semiconductor switches 10*a* and 10*b*, whereby first the first semiconductor switch (IGBT) 10*a* and then the second semiconductor switch (MOSFET) 10*b* are switched conductively. Timing member 10*f* is started at the same time. After the time interval which is predetermined or set by timing member 10*f* has elapsed, semiconductor switches 10*a* and 10*b* are blocked and brought into the non-conductive state. The current flowing during the arc duration is conducted across auxiliary contact 9 and semiconductor electronic device 10 for the duration of timing member 10*f*, so that the arc can extinguish.

The contact difference $\Delta L_H = L_{Hi} - L_{Ha}$ between main and auxiliary contact 8 and 9 is designed in such a way that during the unplugging operation an arc can be produced between main plug-in contact 8*a* and main opposite contact 8*b*. The contact distances $L_{Hi}$ and $L_{Ha}$ in this regard are the distance between the particular contact tip of plug-in contact 8*a*, 9*a* and the opening edge or socket edge of the associated opposite contact 8*b* or 9*b*, respectively. The amount of the contact difference $\Delta L_H$ in this regard is designed in such a way that in the case of an arc sufficient time remains in main contact 8 to extinguish it and to block the current flow. Thus, no other arc can form in auxiliary contact 9 between its auxiliary plug-in contact and auxiliary opposite contact 9*a* and 9*b*.

In addition to the setting or establishing of the contact difference $\Delta L_H$ between main and auxiliary contact 8 or 9, the time member 10*f* of the semiconductor electronic device 10 is designed in such a way that at typical pulling speeds of the unplugging operation and depending on the source voltage and load 3 sufficient time remains to the mechatronic plug-in connector system 1 until complete mechanical separation of all contacts 8, 9.

Figure 2:
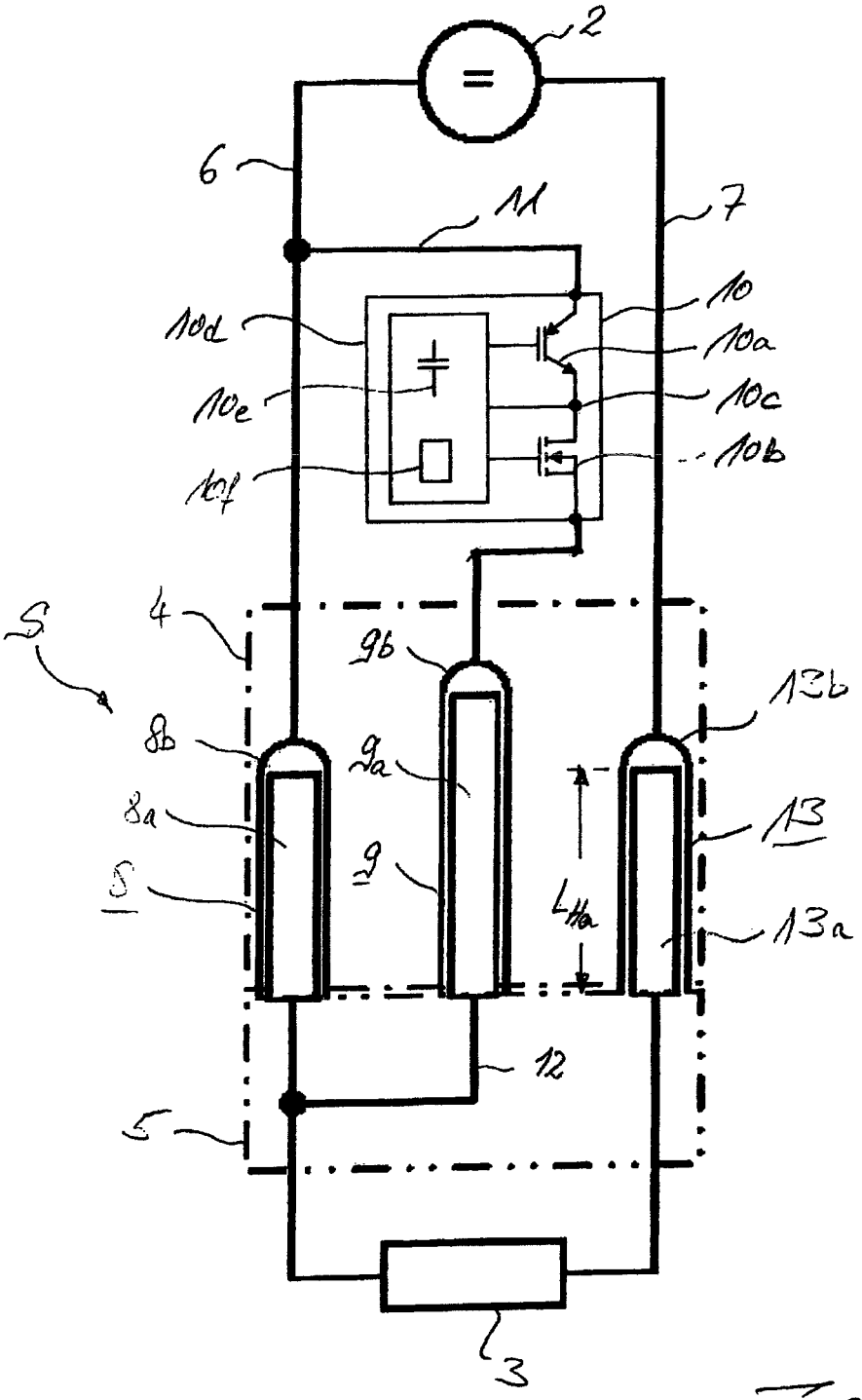
FIG. 2 in a diagram according to FIG. 1 shows a plug-in connection system with an additional third contact leading the auxiliary contact.
Figure 3:
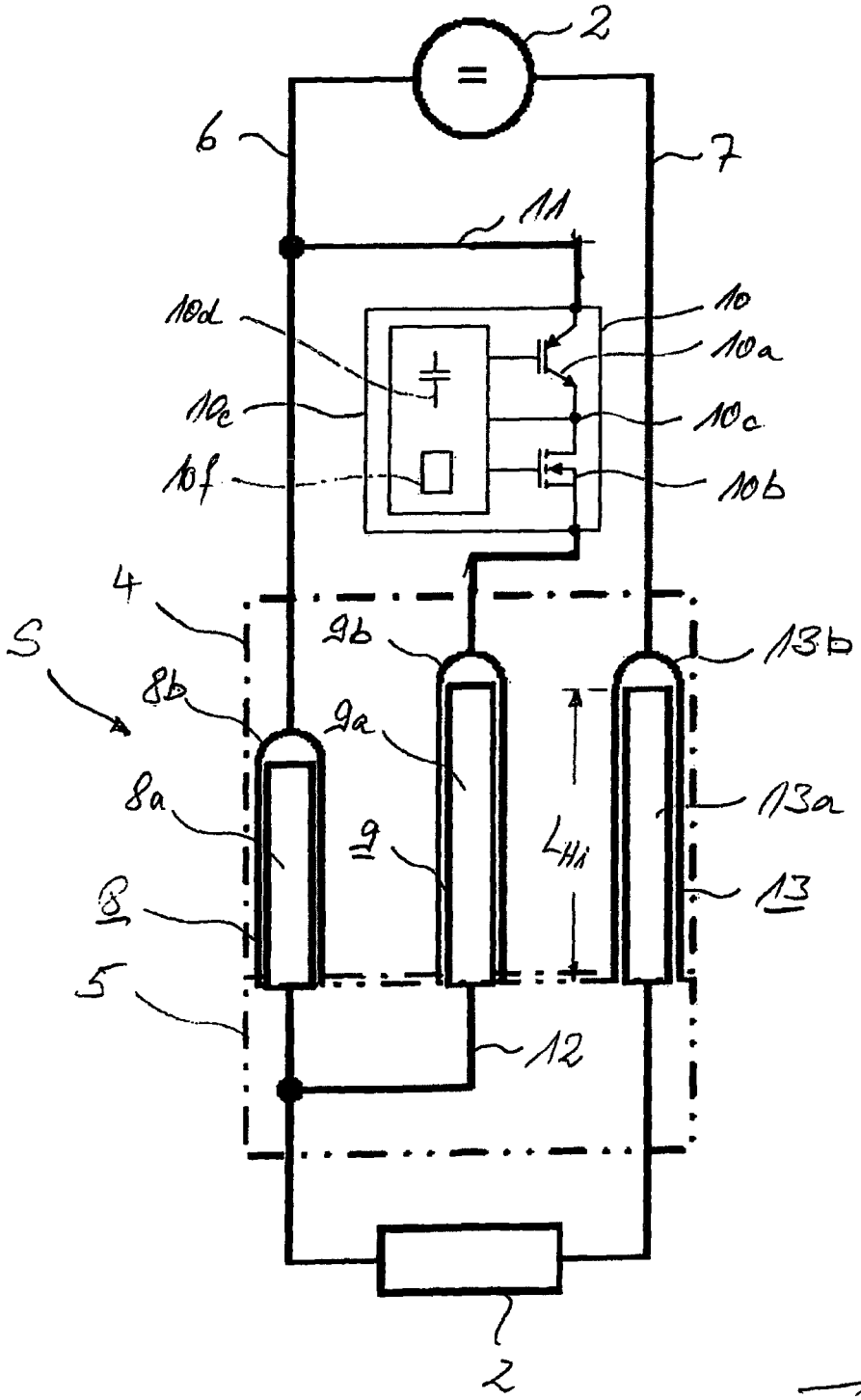
FIG. 3 shows a plug-in connection system according to FIG. 2 with an additional third contact lagging behind the main contact.

In the embodiment according to FIGS. 2 and 3, mechatronic plug-in connector system 1 comprises a third contact 13 with again a plug-in contact 13*a* and also an opposite contact 13*b* made as a socket. Third contact 13 is integrated with its opposite contact 13*b* together with main and auxiliary opposite contact 8*b* and 9*b* in socket unit 4 and with its plug-in contact 13*a* together with main and auxiliary plug-in contact 8*a* and 9*a* in plug unit 5. Third contact 13 in the present exemplary embodiment is located in return conductor 7.

Whereas in the exemplary embodiment according to FIG. 2 third contact 13 has a contact distance $L_{Ha}$ that is shorter compared with auxiliary contact 9 and the same as main contact 8, in the embodiment according to FIG. 3 the contact distance of third contact 13 is the same as the contact distance $L_{Hi}$ of auxiliary contact 9. The plug contact or plug-in contacts 8*a*, 9*a*, and/or 13*a* can also have the same length and opposite contacts (sockets) 8*b*, 9*b*, or 13*b*, accordingly can be different in length.

During an unplugging operation, i.e., during pulling of plug unit 5 out of socket unit 4, in the embodiment according to FIG. 2 an arc can be produced also between plug-in contact 13*a* and opposite contact 13*b* of third contact 13. The mode of operation of electronic device 10 corresponds to the statements made above. Due to the current commutated to the series connection of auxiliary contact 9 with semiconductor electronic device 10 during the unplugging operation the arc extinguishes both at main contact 8 and third contact 13, so that the voltage difference between contacts 8*a* and 13*a*, on the one hand, and contacts 8*b* and 13*b*, on the other, approaches zero.

In the embodiment according to FIG. 3, because of suitable matching of the distance difference $\Delta L_H$ between main contact 8, on the one hand, and auxiliary contact 9 and third contact 13, on the other, with a suitable setting of timing member 10*e* of the semiconductor electronic device, no arcs occur at auxiliary contact 9 and at third contact 13, i.e., between their plug-in and opposite contacts 9*a* and 9*b* or 13*a* and 13*b*.

Figure 4:
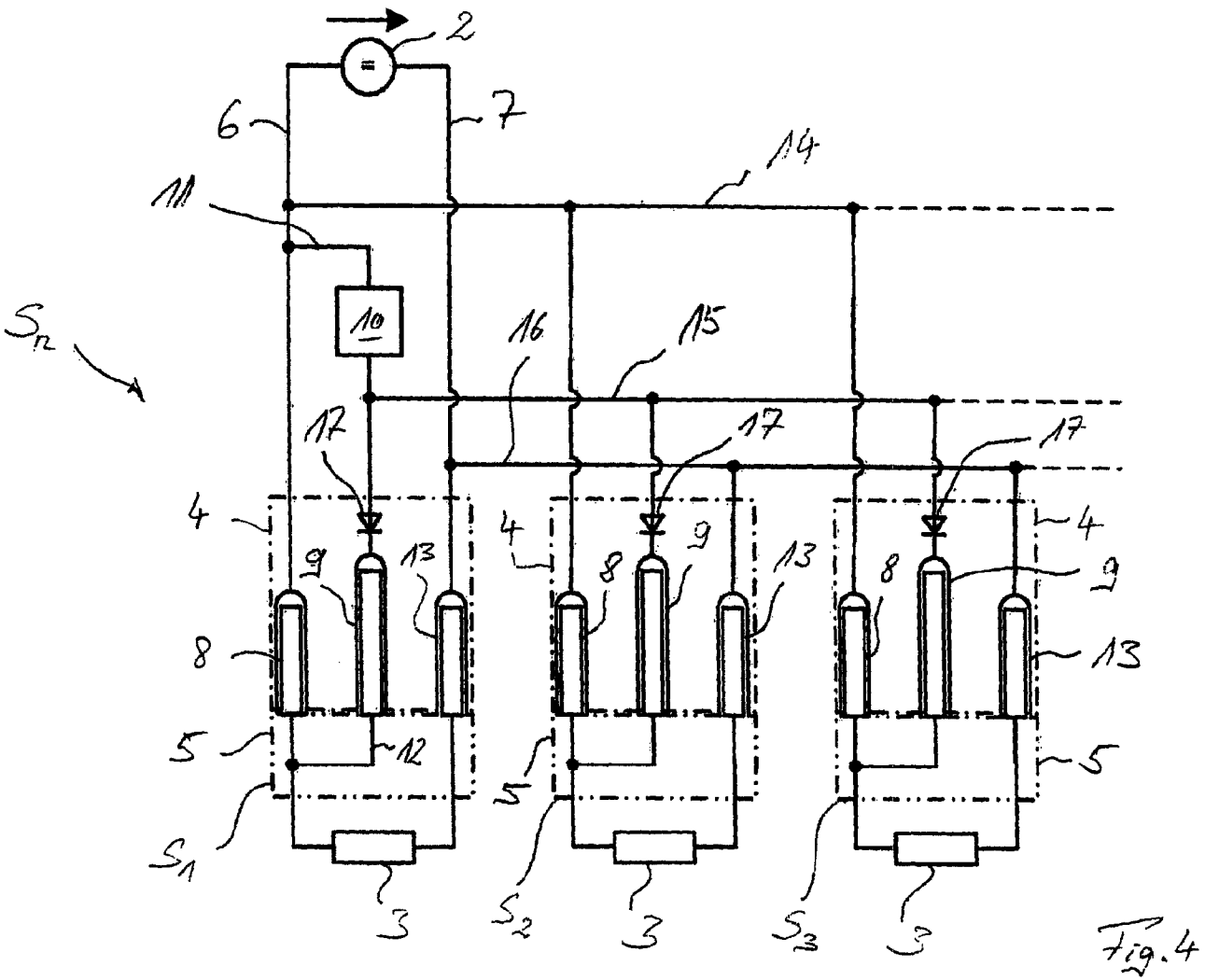
FIG. 4 shows a mechatronic multi-plug system with a number of plug-in connectors (plug-in connection systems) each with a main contact, an auxiliary contact, and a third contact and with a semiconductor electronic device shared by the plug-in connectors.

The multi-plug system $S_n$, shown schematically in FIG. 4, comprises a plurality of plug-in connectors $S_1$, $S_2$, $S_3$, whereby other possible plug-in connectors S may be present. Each of the plug-in connectors $S_{1 \ldots n}$, analogous to the embodiment according to FIG. 2, is made with a main contact 8 and an auxiliary contact 9 and a third contact 13 in a socket-plug unit 4, 5. Plug-in connectors $S_{1 \ldots n}$ are all connected to DC source 2. Each plug-in connector $S_{1 \ldots n}$ is assigned a load 3. Likewise all plug-in connectors $S_{1 \ldots n}$ share the single semiconductor electronic device 10, which analogous to FIG. 1 comprises a series connection with the two semiconductor switches 10*a* and 10*b* and energy storage device 10*d* and timing member 10*f* of control unit 10*e*.

Main contacts 8 of plug-in connectors $S_{1 \ldots n}$ are connected via a line 14 to forward conductor 6. Likewise, auxiliary contacts 9 of all plug-in connectors $S_{1 \ldots n}$ are connected to bypass line 11, 12 and thus to electronic device 10 via a line 15. Third contacts 13 of all plug-in connectors $S_{1 \ldots n}$ are connected to return conductor 7 via a line 16.

To avoid a short circuit during an unplugging operation of individual plug-in connectors $S_{1 \ldots n}$ of multi-plug system $S_n$, auxiliary contact 9 of each plug-in connector $S_{1 \ldots n}$ is assigned a diode 17. This is integrated in the particular socket-plug unit 4, 5 and thereby suitably in socket unit 4. The particular diode 17 is connected on the anode side to semiconductor electronic device 10 and on the cathode side to auxiliary opposite contact 9*a* of auxiliary contact 9 of the particular plug-in connector $S_{1 \ldots n}$.

During the unplugging operation of one of plug-in connectors $S_n$, diodes 17 of the other plug-in connectors $S_1$, $S_2$, $S_3$, prevent a short circuit of semiconductor electronic device 10 via plugged-in plug-in contacts 8, 9, 13 of the other plug-in connectors $S_1$, $S_2$, $S_3$ from multi-plug system $S_n$, because no current flow is possible parallel to semiconductor electronic device 10 from lines 14 to line 15 across the plugged-in main and auxiliary contacts 8, 9, and/or 13.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A mechatronic multi-plug system comprising:

at least two plug-in connectors each with:

a main contact comprising a main plug-in contact and a main opposite contact;

an auxiliary contact lagging behind the main contact in an unplugging operation;

an auxiliary plug-in contact; and an auxiliary opposite contact; and a semiconductor electronic device for extinguishing an arc produced during the unplugging operation, the semiconductor electronic device is shared by the at least two plug-in connectors and is series-connected to each of the auxiliary contacts via a respective diode of each of the at least two plug-in connectors.

2. The mechatronic multi-plug system according to claim 1, the semiconductor electronic device has two series-connected semiconductor switches and an energy storage device that is connected to the semiconductor switches and charges by tapping the arc voltage produced between the semiconductor switches during the unplugging operation.

3. The mechatronic multi-plug system according to claim 1, wherein each of the at least two plug-in connectors has a third contact comprising a plug-in contact and an opposite contact.

4. The mechatronic multi-plug system according to claim 3, wherein the third contact of each of the at least two plug-in connectors leads the respective auxiliary contacts during the unplugging operation.

5. The mechatronic multi-plug system according to claim 2, wherein the third contact of each of the at least two plug-in connectors lags behind the respective main contacts during the unplugging operation.

6. A semiconductor electronic device for a mechatronic multi-plug system with a plurality of single plug-in connectors formed of a multiple socket strip or multiple outlet strip, according to claim 1.

* * * * *